US010315740B2

(12) United States Patent
Ferguson et al.

(10) Patent No.: US 10,315,740 B2
(45) Date of Patent: Jun. 11, 2019

(54) TOOLS AND SENSORS DEPLOYED BY UNMANNED UNDERWATER VEHICLES

(71) Applicant: Subsea 7 Limited, Sutton (GB)

(72) Inventors: Hugh Cameron Ferguson, Banchory (GB); James Andrew Jamieson, Balmedie (GB)

(73) Assignee: Subsea 7 Limited, Sutton (GB)

( * ) Notice: Subject to any disclaimer, the term of this patent is extended or adjusted under 35 U.S.C. 154(b) by 14 days.

(21) Appl. No.: 15/033,860

(22) PCT Filed: Nov. 5, 2014

(86) PCT No.: PCT/GB2014/053294

§ 371 (c)(1),
(2) Date: May 2, 2016

(87) PCT Pub. No.: WO2015/067941

PCT Pub. Date: May 14, 2015

(65) Prior Publication Data

US 2016/0264223 A1 Sep. 15, 2016

(30) Foreign Application Priority Data

Nov. 5, 2013 (GB) ..... 1319535.9

(51) Int. Cl.
*B63G 8/00* (2006.01)

(52) U.S. Cl.
CPC ..... *B63G 8/001* (2013.01); *B63G 2008/004* (2013.01)

(58) Field of Classification Search
CPC ..... B63G 8/001; B63G 2008/004
USPC ..... 114/322; 405/184.1
See application file for complete search history.

(56) References Cited

U.S. PATENT DOCUMENTS 3,621,911 A * 11/1971 Baker ..... B63C 11/42 166/336
3,880,103 A 4/1975 Talkington
3,987,741 A 10/1976 Tryon
5,425,599 A * 6/1995 Hall ..... F16L 1/26 405/158
5,947,051 A 9/1999 Geiger
6,167,831 B1 1/2001 Watt et al.
(Continued)

FOREIGN PATENT DOCUMENTS

GB 2 453 645 4/2009
JP 07223589 8/1995
(Continued)

*Primary Examiner* — Anthony D Wiest
(74) *Attorney, Agent, or Firm* — Levy & Grandinetti

(57) ABSTRACT

An inspection, monitoring, maintenance or construction task is performed on a subsea structure by using an underwater vehicle to carry a submersible package to the subsea structure. The package comprises a tool or sensor arranged to perform the required task on the subsea structure, and an on-board power unit and controller arranged to power and control the tool or sensor. The package is transferred from the underwater vehicle to be supported by the subsea structure. The underwater vehicle can then stand off from the package. While the package is supported by the subsea structure, the tool or sensor of the package performs the required task on the subsea structure, powered and controlled by the on-board power unit and controller of the package.

28 Claims, 6 Drawing Sheets

(56) References Cited

U.S. PATENT DOCUMENTS

| | | | | |
|---|---|---|---|---|
| 6,223,675 | B1 * | 5/2001 | Watt | B63G 8/001 114/312 |
| 6,600,695 | B1 | 7/2003 | Nugent et al. | |
| 7,926,438 | B2 * | 4/2011 | Guerrero | B63C 11/52 114/312 |
| 8,619,134 | B2 * | 12/2013 | Christ | G01N 21/952 348/84 |
| 2009/0095209 | A1 * | 4/2009 | Jamieson | B63G 8/001 114/312 |
| 2012/0261914 | A1 * | 10/2012 | Fontolan | F16L 1/166 285/31 |
| 2012/0289103 | A1 | 11/2012 | Hudson et al. | |

FOREIGN PATENT DOCUMENTS

| | | |
|---|---|---|
| JP | H08145733 | 6/1996 |
| JP | 2003-02 6090 | 1/2003 |
| WO | WO 01/21476 | 3/2001 |
| WO | WO 01/21478 | 3/2001 |
| WO | WO 01/21479 | 3/2001 |
| WO | WO 01/53149 | 7/2001 |
| WO | WO 01/98140 | 12/2001 |
| WO | WO 02/084217 | 10/2002 |
| WO | WO 2009/061562 | 5/2009 |
| WO | WO 2010/105003 | 9/2010 |
| WO | WO 2012/156425 | 11/2012 |
| WO | WO 2012/040296 | 3/2013 |
| WO | WO 2013/046577 | 4/2013 |

* cited by examiner

TOOLS AND SENSORS DEPLOYED BY UNMANNED UNDERWATER VEHICLES

This invention relates to tools and sensors for use by unmanned underwater vehicles (UUVs) in subsea operations, such as those related to offshore oil and gas production. The invention also relates to methods for using UUVs, tools and sensors in subsea operations.

It is often necessary to perform inspection, monitoring, maintenance and construction tasks during subsea operations. Below diver depth, such tasks are generally performed by UUVs such as remotely-operated vehicles (ROVs), autonomous underwater vehicles (AUVs) and autonomous inspection vehicles (AIVs).

ROVs are characterised by a physical connection to a surface support ship via an umbilical tether. The tether carries power, data and control signals and so enables long-term operation of the ROV, albeit limited in working radius relative to the support ship by the length of the tether.

Work-class ROVs are large and powerful enough to perform a variety of subsea maintenance and construction tasks, for which purpose they may be adapted by the addition of specialised skids and tools in a modular fashion. For example, WO 03/097446 describes how an ROV may need different tools for different operations and so may be deployed with a set of interchangeable tools. Such tools may, for example, include torque tools and reciprocating tools driven by hydraulic or electric motors or actuators. Hydraulic motors or actuators run on pressurised hydraulic fluid, typically supplied by a skid coupled to the ROV. For the purposes of this specification, a skid may be regarded as part of the ROV or other UUV to which it is coupled.

Inspection-class ROVs are smaller but more manoeuvrable than work-class ROVs to perform inspection and monitoring tasks, although they may also perform light maintenance tasks such as cleaning using suitable tools. In addition to visual inspection using lights and cameras, inspection-class ROVs may hold sensors in contact with, or in proximity to, a subsea structure to inspect and monitor its condition or other parameters. A subsea structure can be any equipment installed subsea, including pipelines, manifolds, valves, structural supports, mudmats, buoyancy tanks, risers, umbilicals and so on.

Examples of sensors used on subsea structures are a CP probe to test cathodic protection and a UT gauge to measure thickness ultrasonically and so to monitor the effects of corrosion. Such sensors require electrical power, which again is supplied from the ROV.

AUVs and AIVs are autonomous, robotic counterparts of work-class and inspection-class ROVs respectively. They move from task to task on a programmed course for limited periods without a physical connection to a surface support ship. However, they must make frequent trips to the surface or to a subsea garage for battery recharging; they also require large batteries for adequate endurance between recharges. A wireless data connection is typically used to download instructions to, and to upload data from, an AUV or AIV.

Hybrid ROVs or HROVs are also known: they can operate either autonomously like AUVs or via a physical connection to a support ship like ROVs.

To avoid the need for a UUV to make a lengthy trip to the surface whenever tools or sensors are to be interchanged, a set of tools or sensors may be stored in a deployment basket that is lowered to a suitable location so that the UUV can fetch and couple the appropriate tool or sensor to itself as and when necessary.

The chosen tool or sensor may be held and manipulated by a manipulator arm of the UUV, for which purpose the tool or sensor may have a handle that is shaped to be held by a grab on the manipulator arm. It is of course possible instead for a tool or sensor to be mounted to a hull or other structure of the UUV or integrated with the UUV.

Inspection, monitoring, maintenance and construction tasks take significant periods of time to complete. During those periods, UUVs performing those tasks must remain on station to support, control and provide power to the tools or sensors they use. This ties up the UUVs and makes them unavailable for other tasks.

The result may be to prolong the project or to require the use of additional UUVs, if the parallel use of multiple UUVs is feasible. Both outcomes involve great expense. In particular, tying up a UUV that depends upon a support ship—particularly an ROV that remains tethered to the ship—ties up the ship too. Support ships may cost hundreds of thousands of US dollars a day to operate. Also, as support ships may cost tens of millions of US dollars in capital outlay, any delays will tie up a valuable capital asset.

Several patent applications describe how an ROV may be tethered to a subsea unit such as a power unit, a tether management system or a subsea garage. Examples are disclosed in U.S. Pat. No. 3,880,103, GB 2453645, WO 01/21476, WO 01/21478 and WO 01/21479. Conversely, US 2012/289103 and WO 02/084217 disclose untethered AUVs.

WO 01/53149 describes a deployment basket that carries a main work ROV and a mini ROV and has respective tether management systems. The main ROV and the mini ROV can cooperate to perform a task, or one ROV can help to rescue the other in the event of a problem such as entanglement. Also, if a problem arises with the main ROV, certain functions can continue to be accomplished by the mini ROV as a backup until the main ROV can be replaced or repaired. However, this is a costly approach that undesirably increases the total number of ROVs in use on a project. Also, by linking ROVs via their tethers to the shared deployment basket, the problem of ROVs having to remain on station is exacerbated because both ROVs must complete their allotted tasks before either ROV can come off station.

WO 2009/061562 discloses a system for subsea work, in which multiple untethered AUVs cooperate with a central docking station. The AUVs return to the docking station periodically to reprogram them and to charge their batteries. The docking station frees a support ship from having to remain on station at the surface. However, as different AUVs are used for different tasks, the system described in WO 2009/061562 is complex, expensive and inflexible.

U.S. Pat. No. 5,947,051 describes a self-propelled 'surface-adhering' underwater robotic vehicle. The vehicle can move itself through water to attach itself to an underwater structure. The vehicle can then move along that structure to perform various tasks. Tools and measurement and inspection devices are carried by the vehicle as appropriate for the tasks required. Also, an enclosure can be purged to provide a dry environment for accomplishing tasks underwater such as hull cleaning and welding. However, the vehicle described in U.S. Pat. No. 5,947,051 is bulky and costly: being, in effect, an ROV with additional surface-crawling capabilities and on-board tools and sensors, it ties up an ROV (namely, itself) until it has performed the task it is programmed to do.

WO 2013/040296 describes an autonomous skid, which exchanges data with, and is recharged by, an ROV. However, such a skid cannot be deployed by an ROV: it has to be carried and deployed by a surface vessel.

It is known for subsea control modules of manifolds or wellheads to be installed and retrieved by a UUV. However, the purpose of such modules is not to perform inspection, monitoring, maintenance or construction tasks on a subsea structure: they cannot be regarded as tools or sensors designed for such purposes. Also, such modules are not autonomous as they have to be connected to a power supply from the surface via an umbilical.

Small self-powered autonomous subsea units such as transponders and beacons are also known. Whilst they are typically UUV-portable, such units generally interact with a surface vessel rather than with the UUV that carries them. Also, such modules and units are not tools or sensors that are capable of performing specific inspection, monitoring, maintenance or construction tasks on a subsea structure such as a pipeline.

WO 2013/046577 describes an underwater vehicle having an arm which carries a package for monitoring a subsea structure. The underwater vehicle and the package form an assembly and remain as such for the duration of the assembly being submerged. The vehicle remains attached to the package whilst the package monitors the subsea structure.

WO 0198140 describes an underwater vehicle which can be either manned or unmanned. A chassis is also described. The chassis may be in the form of a digger and has several cones to provide guiding formations as well as power and data transfer from the vehicle to the chassis. Ordinarily, the chassis remains on the sea bed. When mechanical operations, such as digging, are required the vehicle connects to the chassis to control the chassis. Once operations have been completed, the vehicle is removed from the chassis which remains on the sea bed until future operations are needed.

JPH 08145733 describes an underwater vehicle which is connected to a mother ship by a cable so as to be controlled thereby. The vehicle carries a package during descent from the mother ship to the sea bed. A fibre optic cable connects the vehicle to the package. Once the vehicle reaches the sea bed, the fibre optic cable is severed to disconnect the package from the vehicle. A camera and a light are provided on the package to perform surveillance activities whilst the package is stationary on the sea bed. Buoyancy of the vehicle is increased by virtue of disconnection from the package such that the vehicle floats up to the mother ship. Accordingly, after detachment, the vehicle is no longer available underwater for any subsea tasks. In addition, the vehicle is no longer in communication with the package after the fibre optic cable has been severed. In order to raise the package, a signal is sent from the mother ship to the package to release a weight to increase buoyancy of the package.

It is against this background that the present invention has been devised.

From one aspect, the invention resides in a method of performing an inspection, monitoring, maintenance or construction task on a subsea structure. The method comprises: moving an underwater vehicle to carry a submersible package comprising a tool or sensor to the subsea structure; transferring the package from the underwater vehicle to be supported by the subsea structure; and performing the task on the subsea structure using the tool or sensor of the package powered from an on-board power unit of the package, while the package is supported by the subsea structure and the underwater vehicle stands off from the package to remain available underwater for performing, supervising or controlling another subsea task.

The underwater vehicle may stand off from the package to remain available underwater for communicating with the package.

The underwater vehicle may stand off from the package to remain available underwater for providing power to the package.

The on-board power unit may be supplied, charged or replenished from an external energy source while the package is supported by the subsea structure. However, the tool or sensor may be powered from the on-board power unit while the package is not connected to the external energy source.

A program is suitably run on board the package, or the package is otherwise controlled, to perform the task autonomously or semi-autonomously of the underwater vehicle. Preferably, the package is at least partially self-controlled to perform the task.

Data may be communicated between the package and the underwater vehicle while the underwater vehicle stands off from the package. In that case, the underwater vehicle may relay data from the package to a suitable receiving point. It is also possible for the data to comprise control signals sent from the underwater vehicle to the package.

The package may be moved relative to the subsea structure while the package is supported by the subsea structure after being transferred from the underwater vehicle. Preferably, such movement of the package relative to the subsea structure is self-propelled.

When the task has been completed or interrupted, the package may be transferred from the subsea structure to an underwater vehicle. Then, the underwater vehicle may be moved to carry the package to a location at which the package is stored or recharged or replenished or data is downloaded from the package. Once recharged or replenished, the package may be carried to a subsea structure to perform another task on that structure.

Upon its transfer from the underwater vehicle, the package may be attached to a mounting structure such as a rail or bracket previously attached to the subsea structure. A rail is an example of a mounting structure that allows the package to be moved along the mounting structure, relative to the subsea structure, after being attached to the mounting structure.

The inventive concept embraces a submersible package that is attachable to a subsea structure and that is dependent upon an underwater vehicle for movement through water to the subsea structure. The package of the invention comprises: a tool or sensor arranged to perform an inspection, monitoring, maintenance or construction task on the subsea structure; an on-board power unit arranged to power the tool or sensor to perform the task; and an on-board controller arranged to control the tool or sensor to perform the task.

The package suitably further comprises an attachment facility for attaching the package to a subsea structure and/or to an underwater vehicle. The package preferably further comprises an on-board attachment and release system that is arranged to drive the attachment facility. The controller is suitably programmed to control the tool or sensor to perform the task autonomously or semi-autonomously of a host underwater vehicle.

The package of the invention may further comprise an on-board drive system arranged to act on a subsea structure to which the package is attached, to move the package relative to that structure when performing a task or tasks at different locations on the structure.

The package of the invention may further comprise an on-board input/output module arranged to transmit data to an external receiver and/or to receive command signals from an external controller.

The inventive concept extends to a system for performing an inspection, monitoring, maintenance or construction task on a subsea structure. The system of the invention comprises: a submersible package of the invention; an underwater vehicle movable to carry the package to the subsea structure; and a transfer arrangement for transferring the package from the underwater vehicle to be supported by the subsea structure, whereby the underwater vehicle is movable while remaining underwater to stand off from the package while the package is supported by the subsea structure for the tool or sensor of the package to perform the task on the subsea structure.

For example, the package may be carried to the subsea structure by a manipulator of the underwater vehicle. Such a manipulator may serve as the transfer arrangement of the system.

The system of the invention may further comprise a deployment device for lowering the package separately from the underwater vehicle, from which device the underwater vehicle can fetch the package underwater to carry the package to the subsea structure.

Briefly to summarise the invention, an inspection, monitoring, maintenance or construction task is performed on a subsea structure by using an underwater vehicle to carry a submersible package to the subsea structure. The package comprises a tool or sensor arranged to perform the required task on the subsea structure, and an on-board power unit and controller arranged to power and control the tool or sensor and other optional systems of the package.

The package is transferred from the underwater vehicle to be supported by the subsea structure. The underwater vehicle is then free to stand off from the package and to perform other tasks, although the vehicle may retain a master/slave relationship with the package to some extent. While the package is supported by the subsea structure, the tool or sensor of the package performs the required task on the subsea structure, powered and controlled by the on-board power unit and controller of the package.

The principle of the invention is that self-powered and self-functioning tooling and instrument packages can be deployed to a subsea structure by a UUV, either by a standard ROV or an autonomous UUV such as an AUV. The UUV then stands off whilst the deployed package operates. However, the UUV may remain involved in controlling, monitoring or servicing the package while the package performs its designated task on the subsea structure.

The tooling and instrument packages of the invention can comprise standard tool or sensor systems, for example torque tools or pressure-, temperature-, CP- or environmental-sampling units. The packages may also include: a deployment vehicle attachment mechanism; a structure attachment mechanism, which may also serve as the deployment vehicle attachment mechanism; self-contained power and computer control; a data transmission system; a self-propelling mechanism, if required; and a cleaning facility, if required for sensor deployment or tool use.

One or more packages can be attached to or otherwise supported by the UUV at the surface and then carried by the UUV underwater. The UUV can then deploy the package(s) on the subsea structure of interest and, after use, recover and return them to the surface or another desired location. Alternatively one or more packages can be deployed to the seabed separately from a UUV, for example in a deployment basket. The UUV can then dock with and collect the package(s) from the deployment basket, deploy them on the subsea structure of interest and, after use, recover and return them to the deployment basket.

Packages of the invention may, for example, be attached to a UUV or other deployment system via a mechanical dock or an electromagnet, or may be held in a manipulator or another structure of a UUV.

In use of the system of the invention, a UUV will approach and attach a package to a subsea structure, using a capture device that may be on the package itself and/or on the structure. After use, a release mechanism will be activated, preferably by the UUV, to recover the package and return it to the deployment basket or the surface. Again, the release mechanism may be implemented on the package and/or on the structure.

Once deployed by a host UUV onto a subsea structure, the UUV stands off and remains available underwater for performing, supervising or controlling another subsea task. The package will perform its designated task, preferably autonomously or semi-autonomously of the UUV.

The degree of autonomy of the package depends upon the arrangements made to power and control the package when it is in place on the subsea structure, separated from the physical support of the UUV that carried it to the structure.

In terms of power, the package can operate fully autonomously if it is self-powered, at least until an on-board or internal power source of the package requires replenishment. In that sense, the package can operate semi-autonomously in power terms if it needs to be connected only intermittently to an external power source for charging or replenishment of an internal power source such as a battery, for example via a power cable extending to a UUV or indeed to another external power source such as may be provided on or near to the subsea structure.

It is preferred that charging or replenishment of an on-board power source of the package can be conducted while the package remains supported by the subsea structure. However, it is possible additionally or alternatively for a UUV to detach the package from the subsea structure and carry it to another location for recharging or replenishment, such as to a suitably-equipped subsea garage or deployment basket.

It is also possible for the package to operate non-autonomously in power terms by remaining connected to an external power source while performing its designated task. However, if the external power source is a UUV, such a connection via a cable may undesirably restrict movement and hence parallel functionality of the UUV.

In terms of control, if operating fully autonomously, the package may perform its designated task substantially without external control inputs from the UUV or elsewhere. However, an external triggering signal from a UUV or other external controller could, for example, be used to start, stop or pause a programmed routine that the package can carry out to perform a task without requiring external control input during that routine.

If operating semi-autonomously in control terms, the package may perform its task with some but not all of its behaviour determined by external control signals. For example, the package may be programmed to execute various sub-routines without requiring external control input during those sub-routines. However, whether and when to execute a particular sub-routine may be subject to the package reporting its status to an external controller and waiting for a suitable triggering signal from that external controller to initiate the appropriate sub-routine.

An external controller may be located on the UUV, located elsewhere on or near to the subsea structure or located at the surface, under the direction of a human operator.

As a high degree of autonomy such as self-power and on-board control are preferably built into the package rather than the host UUV, this removes the need for the UUV to remain in the vicinity while sensor measurements are taken or other operations are performed on the subsea structure by the package. The UUV may also be freed if power and/or control are provided to the package from another external source on or near to the subsea structure.

Non-autonomous operation is also possible in control terms, in which external control inputs determine substantially the entire behaviour of the package. Such inputs may be provided by the UUV while the UUV stands off and is available for other tasks, or by another external controller located on or near to the subsea structure or at the surface.

Thus, a UUV may be used as a 'master' subsea power and/or data relay to control one or more 'slave' packages, for example packages with monitoring or sensor functionality. The UUV is therefore free to perform other tasks, minimising tie-up of the UUV and of any associated surface support vessel. Afterwards, the host UUV, or a different UUV, comes back and picks up the package for storage and maintenance, for example to upload data and recharge the battery before re-use. As the package will generally be small and so has small batteries and storage relative to a UUV, it has limited autonomy and other capabilities compared to an AUV for example. In particular, the package need not be capable of self-propulsion through water and so can omit thrusters and the related propulsion and power systems that characterise a UUV.

In order that the invention may be more readily understood, reference will now be made, by way of example, to the accompanying drawings, in which.

Figure 1:
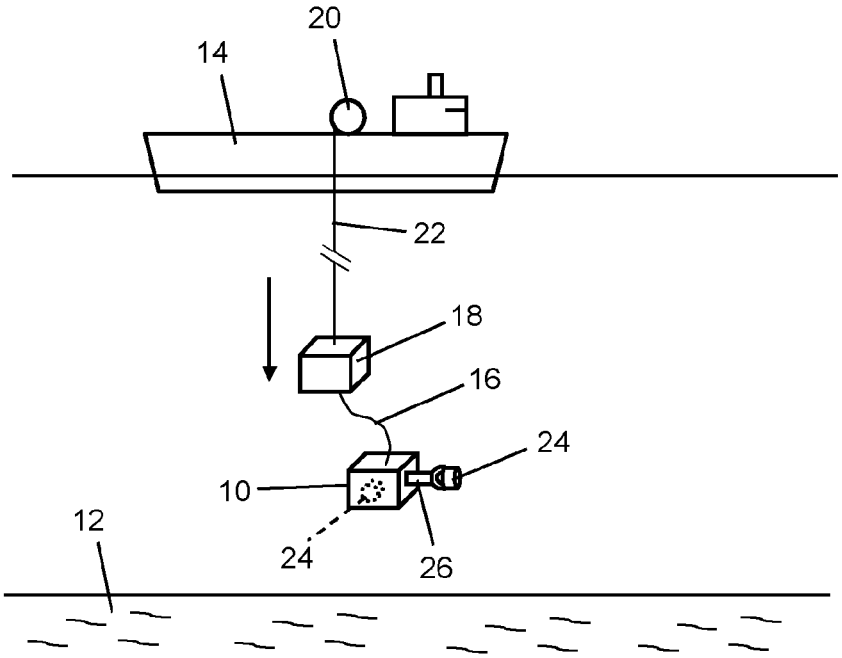
FIG. 1 is a schematic perspective view of an ROV suspended from a surface support vessel, being lowered to the seabed while carrying one or more autonomous packages in accordance with the invention.

FIG. 1 of the drawings shows a first embodiment of the invention in the context of an ROV 10 being lowered toward the seabed 12 from a surface support vessel 14. In conventional manner, the ROV 10 is joined by a tether 16 to a tether management system 18 that is suspended from a winch 20 on the vessel 14 by an armoured cable 22.

The ROV 10 takes electrical power from the vessel 14 via the tether 16 and the cable 22. Two-way data signals including control signals and video signals follow the same route between the vessel 14 and the ROV 10.

In accordance with the invention, the ROV 10 carries one or more autonomous packages 24 with tool and/or sensor functionality. In FIG. 1, one of those packages 24 is shown held by a manipulator arm 26 of the ROV 10 during transit to the seabed 12. For this purpose, the package 24 may be provided with a handle shaped to be grabbed by the ROV 10. Such a handle may take any well-known form, such as a fishtail shape, and so has been omitted from the drawings for clarity.

It is also, or alternatively, possible for one or more packages 24 to be supported elsewhere on the ROV 10. To illustrate this, FIG. 1 shows another package 24 in dotted lines, attached to the hull of the ROV 10 by a releasable connection such as a mechanical connector or an electromagnet. The connection may be driven either by the package 24 or by the ROV 10 when the package 24 is to be attached or released.

Figure 2:
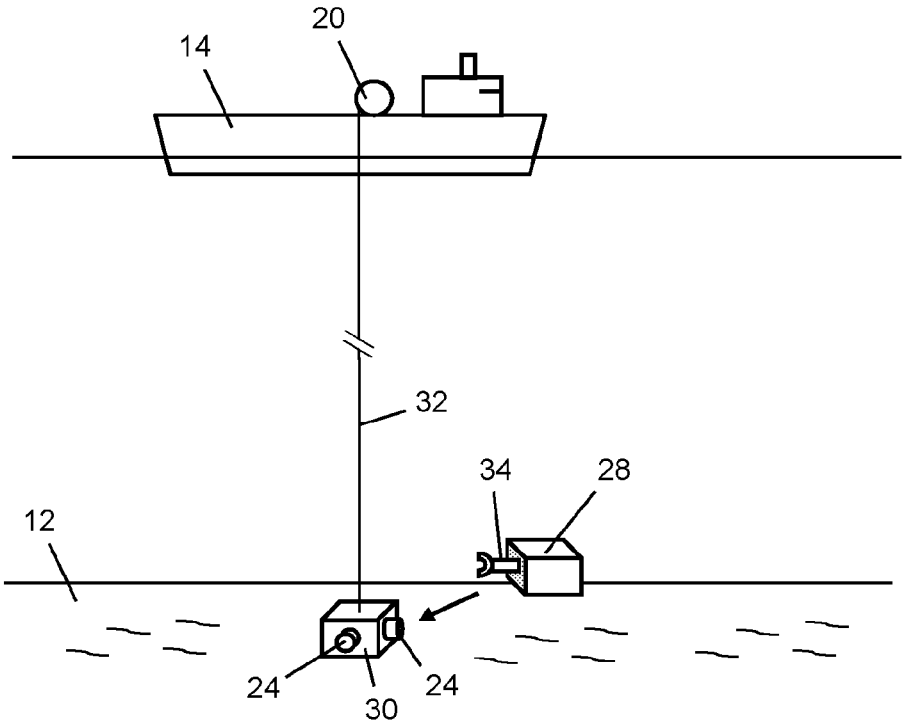
FIG. 2 is a schematic perspective view of an AUV moving to interact with a deployment basket lowered from a surface support vessel onto the seabed, the basket carrying multiple autonomous packages in accordance with the invention.
Figure 3:
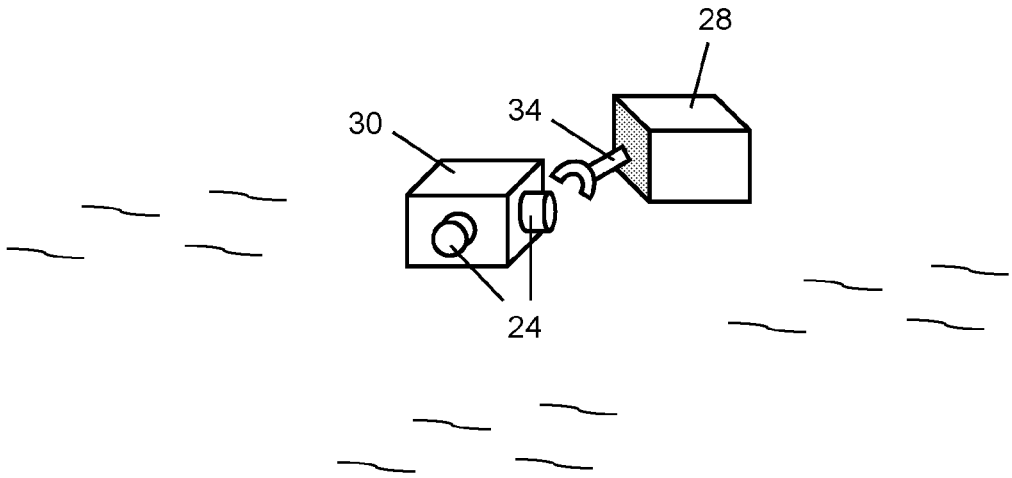
FIG. 3 is an enlarged schematic perspective view of the AUV of FIG. 2 about to grab one of the packages from the deployment basket on the seabed.

FIGS. 2 and 3 show a second embodiment of the invention in the context of an AUV 28. In FIG. 2, the AUV 28 is shown moving toward a deployment basket 30 that has been lowered to the seabed 12 on a wire 32 hanging from the winch 20 on the surface support vessel 14. The deployment basket 30 carries one or more (in this simple example, two) autonomous packages 24 in accordance with the invention. In FIG. 3, the wire 32 has been detached from the basket 30 and a manipulator arm 34 of the AUV 28 is about to grab one of the packages 24 to remove it from the basket 30. Again, the package 24 may have a handle shaped to be grabbed by the AUV 28 but this has been omitted from the drawings for clarity.

Figure 4:
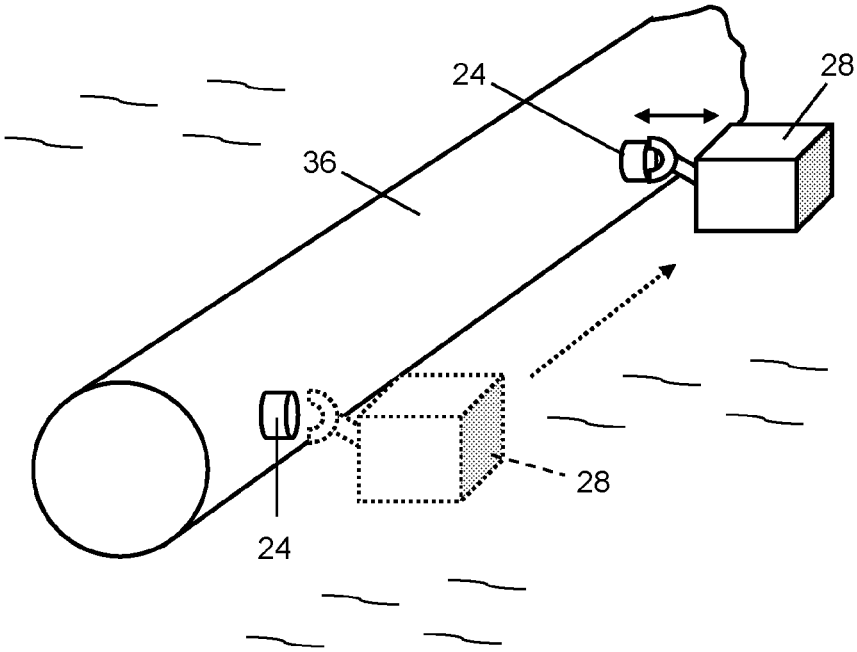
FIG. 4 is a schematic perspective view of a subsea structure to which the AUV of FIG. 2 is attaching, or from which the AUV is removing, two of the packages grabbed from the deployment basket.
Figure 5:
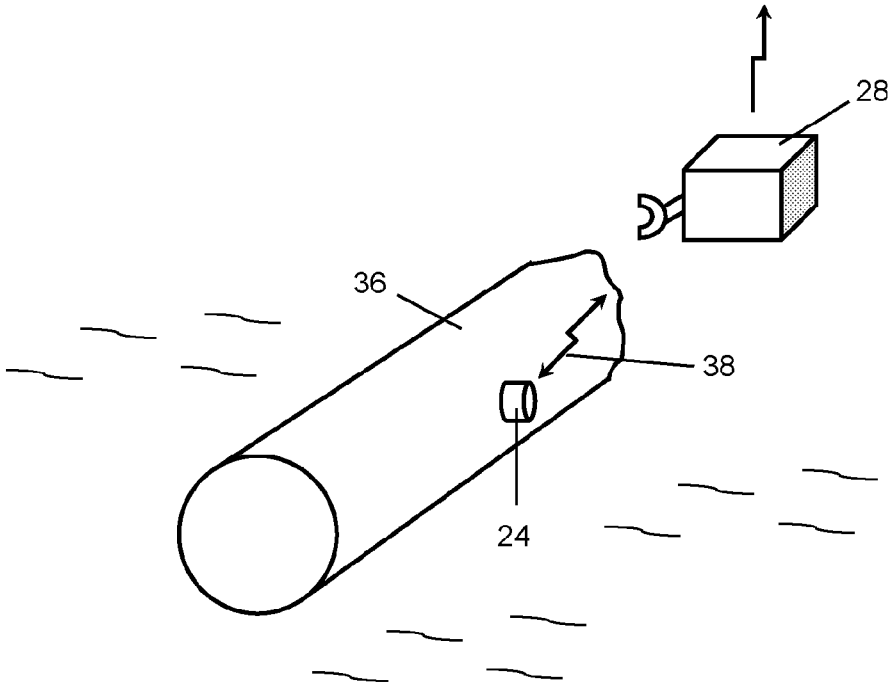
FIG. 5 is a schematic perspective view that shows wireless data communication between a package attached to the subsea structure and the AUV standing off from the package.
Figure 6:
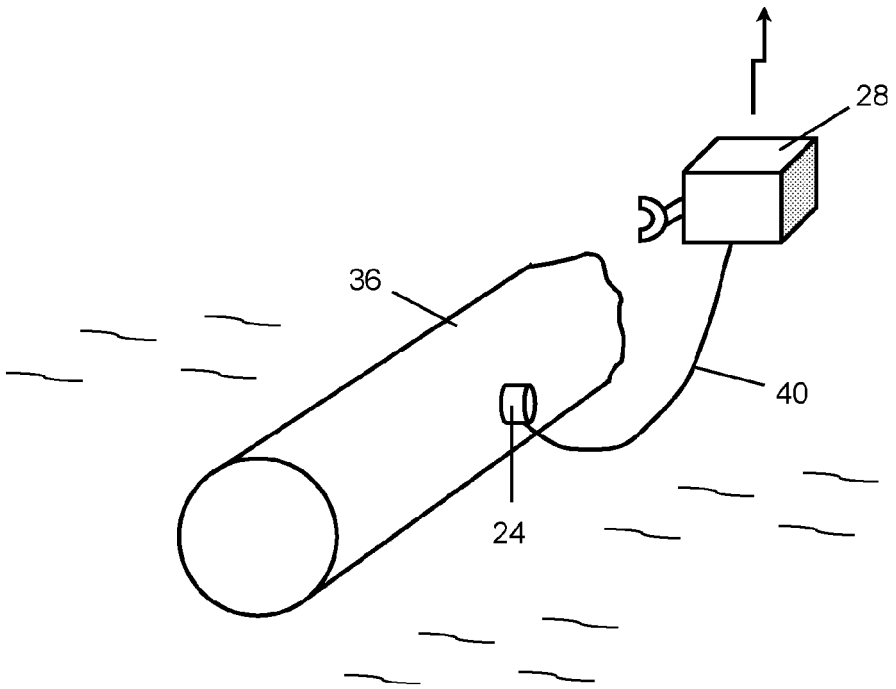
FIG. 6 is a schematic perspective view corresponding to FIG. 5 but showing the alternative of wired data communication between the package and the AUV.

The AUV 28 then carries the package 24 from the basket 30 to a subsea structure to perform tasks such as inspection, monitoring or maintenance, as will be described below with reference to FIGS. 4 to 6. FIGS. 4 to 6 continue with the example of an AUV 28. However, it should be appreciated that a different UUV—such as the ROV 10 of FIG. 1—could be used instead of an AUV 28. Also, the AUV 28 could carry one or more packages 24 attached to its hull in the manner shown for the ROV 10 of FIG. 1.

Referring next, then, to FIG. 4, an AUV 28 is shown attaching a package 24 to a subsea structure exemplified here as a pipeline 36. In this example, the AUV 28 has already attached a package 24 elsewhere on the pipeline 36 before, if necessary, returning to the deployment basket 30 to fetch another package 24. This is to show that one AUV 28 can install—and then interact with and then remove—more than one package 24. However, it is of course possible for the AUV 28 to install, interact with and remove only one package 24. For simplicity, interaction with a single package 24 after its installation will be described with reference to FIGS. 5 to 9.

FIGS. 5 and 6 show the AUV 28 stood off from a package 24 after attaching the package 24 to the pipeline 36. Once the package 24 is attached to the pipeline 36, it can perform tasks on the pipeline 36 that are pre-programmed and/or under the control or supervision of the AUV 28. For example, the package 24 may undertake cleaning or other intervention on the pipeline 36 before measuring a parameter of the pipeline 36 such as its thickness using a sensor such as a UT gauge. Alternatively, the package 24 may have tool functionality, for example a drill or other cutting device to cut away a coating on the pipeline 36 in readiness for subsequent construction operations.

Meanwhile, the AUV 28 is free to perform other tasks, although it may remain continuously or intermittently in two-way data communication with the package 24 by a wireless link 38 as shown in FIG. 5 or by an umbilical connection 40 as shown in FIG. 6. The data communicated may comprise control signals from the AUV 28 to the package 24 and feedback and sensor signals from the package 24 to the AUV 28. Signals received by the AUV 28 from the package 24 may be relayed continuously or intermittently from the AUV 28 to a suitable receiving point at a subsea or surface location. Optionally, signals received by the AUV 28 may be stored in memory on the AUV 28 or pre-processed on the AUV 28 for later download, for example when the AUV 28 returns to a subsea garage or to the surface for recharging and reprogramming.

In comparison with the wireless connection 38 of FIG. 5, a wired connection as shown in FIG. 6 has the advantage of being able to power or charge the package 24 from the AUV 28. However, a wired connection also has the disadvantage of restricting movement of the AUV 28 while the connection is maintained, or of having to make and break the connection if the connection is to be intermittent.

In the simple examples shown in FIGS. 4 to 6, packages 24 are attached to the pipeline 36 without requiring adaptation of the pipeline 36. For this purpose, packages 24 could include arms arranged to embrace, encircle or clamp to a pipeline 36 or other subsea structure, or pads arranged for attachment to the structure by electromagnetism or suction.

FIGS. 7 to 10 show how a subsea structure such as a pipeline 36 may be adapted to enable or facilitate attachment of a package 24 of the invention, by the addition of a mounting structure arranged to support the package 24. Such adaptation may be made during fabrication of the structure or after installation, for example by a UUV that subsequently installs the package 24.

Figure 7:
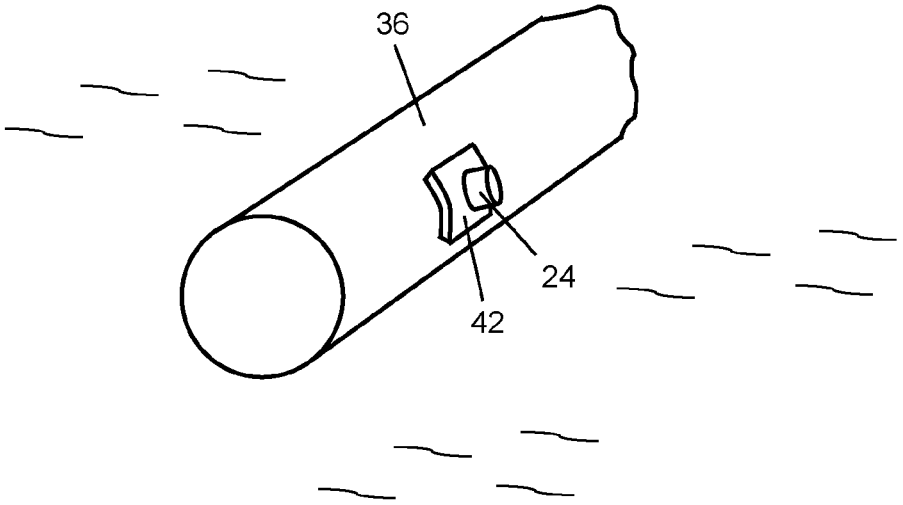
FIG. 7 is a schematic perspective view showing an autonomous package in accordance with the invention attached to a subsea structure via a prefabricated docking bracket provided on the structure.

By way of example, FIG. 7 shows a bracket 42 as an example of a package support that is suitably attached to the pipeline 36 during its fabrication to define a convenient attachment point for a package 24. The bracket 42 and the package 24 suitably have complementary interengageable formations for releasable attachment of the package 24 to the bracket 42 and hence to the pipeline 36. In this example, the bracket 42 defines a socket that receives the package 24, although other formations are possible such as a stud or pin on the bracket 42 that engages into a socket in the package 24.

The package support solution outlined in FIG. 7 is convenient where measurements are to be taken periodically during the life of the pipeline 36 at known, pre-planned locations. In that case, a sensor package 24 can be moved between various ones of such supports to monitor the condition of the pipeline 36 at different locations. Alternatively multiple sensor packages 24 can be installed in parallel on respective supports to monitor the condition of the pipeline 36 simultaneously at multiple locations.

Figure 8:
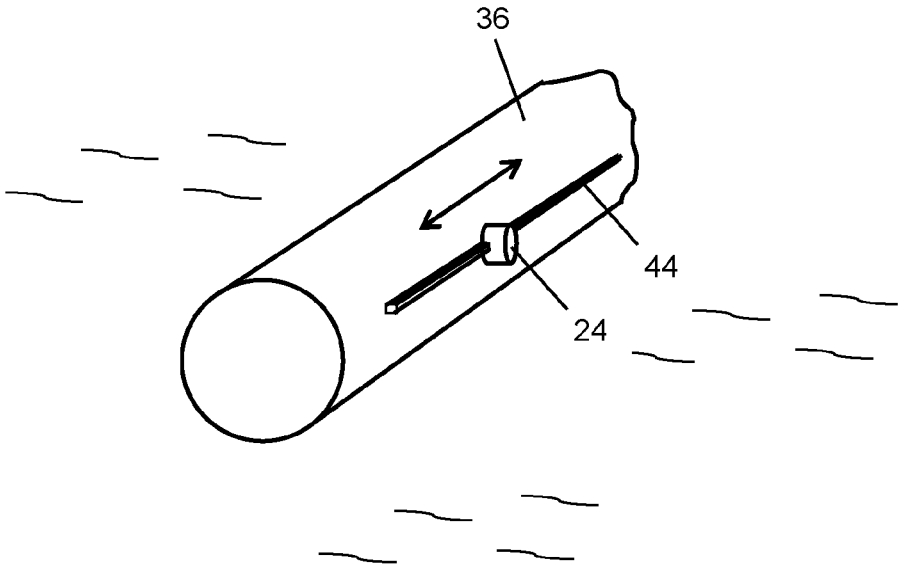
FIG. 8 is a schematic perspective view showing an autonomous package in accordance with the invention attached to a subsea structure via a rail along which the package can move along the structure.
Figure 9:
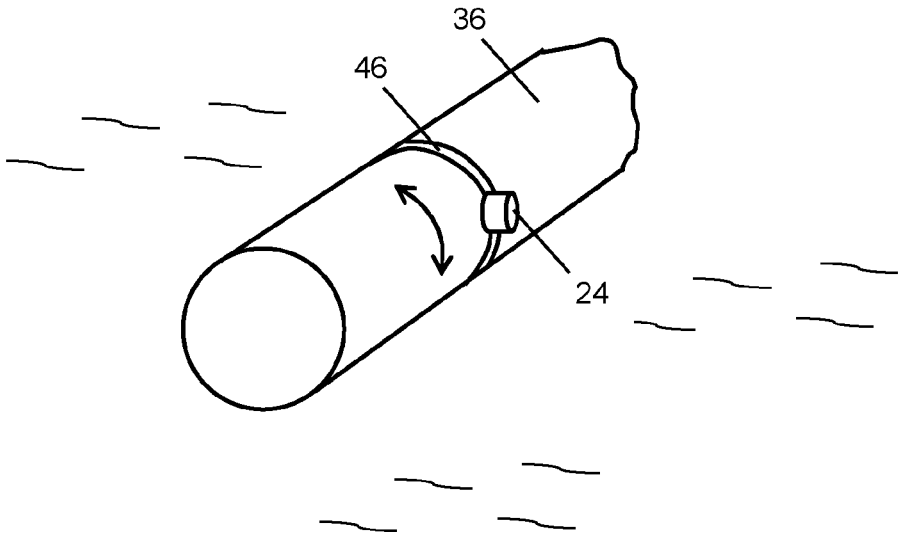
FIG. 9 is a schematic perspective view showing an autonomous package in accordance with the invention attached to a subsea structure via a strap along which the package can move around the structure.
Figure 10:
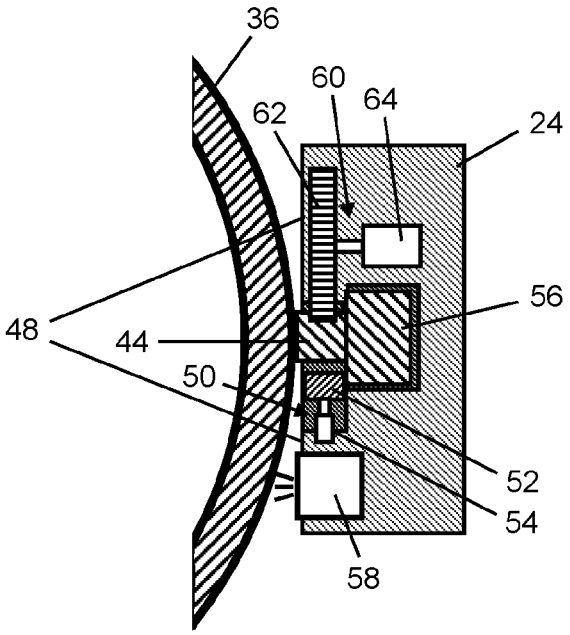
FIG. 10 is a schematic cross-sectional view of the package, rail and subsea structure shown in FIG. 8.

FIGS. 8, 9 and 10 show guides that can be attached to the pipeline 36 to allow the package 24 to move relative to the pipeline 36. The guide in FIGS. 8 and 10 is a rail 44 that extends along the pipeline 36, whereas the guide in FIG. 9 is a strap 46 that extends around the pipeline 36.

In each case, the guide 44, 46 and the package 24 may have complementary formations to enable their inter-engagement, although other attachment systems such as magnetic systems are possible. For example, FIG. 10 shows that the rail 44 of FIG. 8 may have a T-shaped cross-section to be embraced by a C-shaped cross-section of the package 24. The strap 46 of FIG. 9 may have a similar cross-section to the rail 44 of FIG. 8.

FIG. 10 shows, schematically, how the package 24 may be constructed to attach to the guide 44, 46 and hence to attach to a subsea structure to which the guide 44, 46 is mounted. In this example, the guide 44, 46 is a T-section rail 44 and the package 24 comprises arms 48 that are spaced to embrace the rail 44. An attach/release mechanism 50 comprises a pawl 52 on one of the arms 48 that is driven by a double-acting actuator 54 to engage behind an enlarged head portion 56 of the rail 44. A single-acting actuator acting against spring bias could be used instead to drive the pawl 52.

When the package 24 is attached to the guide 44, 46, a sensor payload 58 in the package 24 is brought into contact with the pipeline 36 or at least into proximity to the pipeline 36 to be within sensing range. The sensor payload 58 may be replaced or supplemented by a tool payload if required, such as a cleaning head or a cutting device.

FIG. 10 also shows, schematically, a drive system 60 that enables the package 24 to drive itself relative to the guide 44, 46. In this example, one of the arms 48 of the package 24 includes a pinion gear 62 that, when the pawl 52 is engaged with the rail 44, engages with a toothed rack formation extending along the rail 44. The drive system 60 further comprises a motor/gearbox assembly 64 that turns the pinion gear 62 to advance the package 24 to a desired position along the rail 44 with respect to the pipeline 36. The package 24 may, for example, be moved along the rail 44 to a succession of different positions to obtain a succession of measurements at those positions.

The brackets 42 of FIG. 7 and the guides 44, 46 of FIGS. 8 and 9 can be attached to the pipeline 36 on a vessel or at a spoolbase during fabrication, or on the seabed by a UUV after installation.

Figure 11:
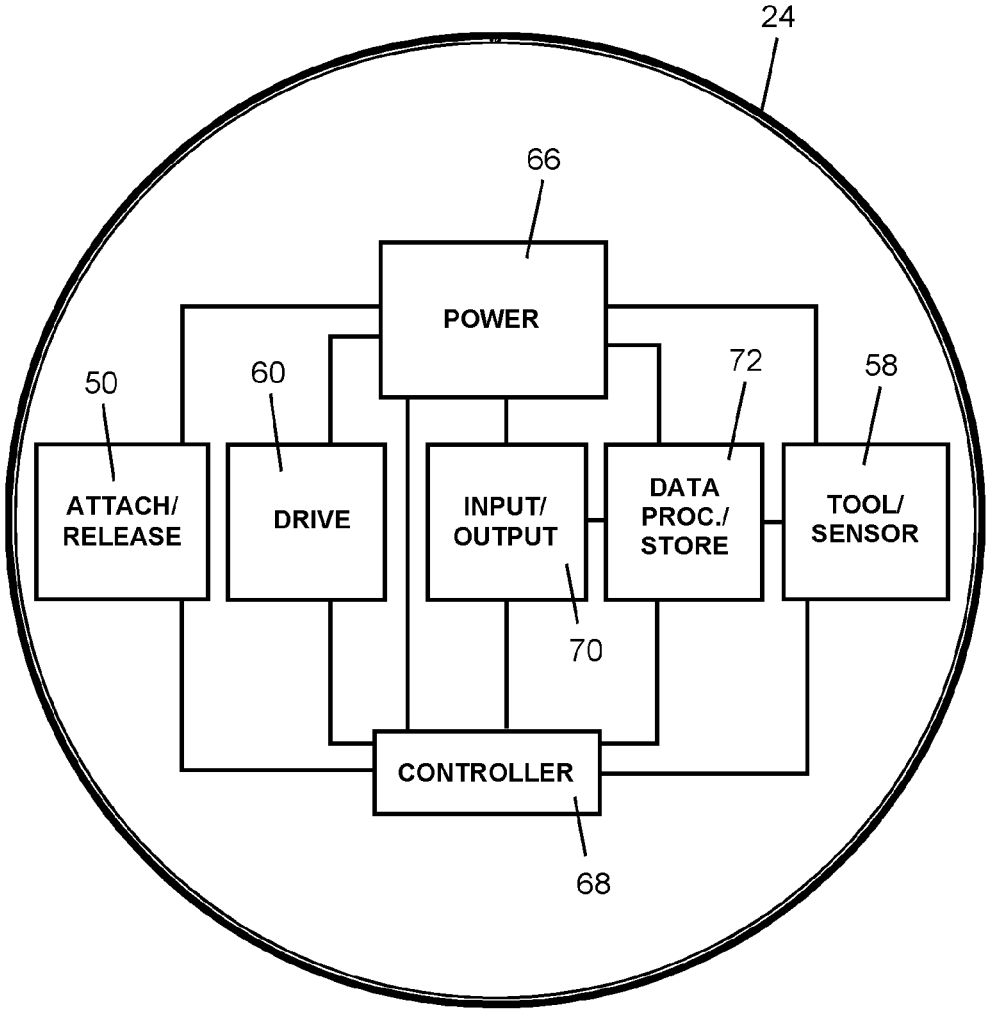
FIG. 11 is a block diagram of the main systems contained in an autonomous package in accordance with the invention.

Turning finally to FIG. 11 of the drawings, this block diagram shows the main systems that are contained in an autonomous package 24 of the invention. An on-board power unit 66 provides electrical (or, as appropriate, hydraulic) power to all of the other systems, including an on-board controller 68 that provides control signals to and receives feedback signals from an attachment/release mechanism 50, a drive system 60, an input/output module 70 and a tool/sensor payload 58. A data processing/storage unit 72 also powered by the power unit 66 interfaces with the controller 68, the input/output module 70 and the tool/sensor payload 58.

The attachment/release mechanism 50 of the package 24 can be electrically or hydraulically powered and is used to attach the package 24 to a subsea structure, for example using the rail or strap guides 44, 46 shown in FIGS. 8 and 9 and further explained with reference to FIG. 10.

The drive system 60 of the package 24 can be electrically or hydraulically powered and is used to self-propel the package 24 relative to the subsea structure once the package 24 is attached to the structure, for example using the rail or strap guides 44, 46 shown in FIGS. 8 and 9.

The input/output module 70 of the package 24 is electrically powered to transmit data to and to receive command signals from a stand-off UUV, either wirelessly as shown in FIG. 5 or by a wired connection as shown in FIG. 6. An external controller other than a UUV could be used instead to receive data from and to transmit command signals to the input/output module 70.

The tool/sensor payload 58 of the package 24 can be electrically powered, if a tool or sensor, or hydraulically or electrically powered, if a tool. A combined tool and sensor payload 58 may be employed, for example a cleaning tool in conjunction with a sensor.

The data processing/storage unit 72 of the package 24 is electrically powered to process and store data received from or to be sent to the controller 68, the input/output module 70 and the tool/sensor payload 58 as appropriate.

The autonomous packages 24 of the invention are suitable for attachment to various subsea structures other than pipelines, such as trees, manifolds, spurs, platform members and hulls.

The invention is not limited to hydraulic tools: electric tools are also possible in autonomous packages 24 of the invention.

Many other variations are possible within the inventive concept. For example, an ROV 10 as shown in FIG. 1 could be used in conjunction with a deployment basket 30 as shown in FIG. 2; conversely, an AUV 28 could be used without the deployment basket 30 shown in FIG. 1, for example instead carrying packages 24 from the surface in the manner of the ROV 10 shown in FIG. 1.

An umbilical connection 40 between a UUV and a package 24 as shown in FIG. 6 may be used for recharging a power unit 66 in the package 24, without necessarily also requiring data transfer along the umbilical 40. In that case, data transfer between the UUV and the package 24 can be effected wirelessly and the umbilical 40 can be disconnected as soon as the power unit 66 of the package 24 is charged, freeing the UUV for other tasks outside the working radius permitted by the umbilical 40.

The attach/release mechanism 50 and the drive system 60 of the package 24 are optional. For example, an attach/release mechanism 50 could be implemented on the subsea structure to engage with a passive docking formation on the package 24 such as a stud, a socket or a hook. Also, it is not essential for a package 24 to be capable of moving itself around a subsea structure. For example, it is not essential for the package 24 to be capable of movement at all once attached to the subsea structure, as will be apparent from FIGS. 4 to 7 of the drawings. Alternatively, the subsea structure could instead support a carriage that moves the package 24 around the structure once the package 24 is attached to the carriage.

The invention claimed is:

1. A method of performing a task, said task being inspecting, monitoring or maintaining a subsea structure or performing a construction task on a subsea structure, comprising:

moving an underwater vehicle to carry a submersible package comprising a tool or sensor to the subsea structure;

transferring the package from the underwater vehicle to be supported by the subsea structure by an attachment facility for attaching the package to the subsea structure, the subsea structure being equipment installed subsea, and/or an underwater vehicle, wherein the attachment facility comprises a formation to engage the subsea structure or the underwater vehicle; and performing the task using the tool or sensor of the package powered from an on-board power unit of the package, the package being at least partially self-controlled to perform the task, while the package is supported by the subsea structure and the underwater vehicle stands off from the package to remain available underwater for communicating with the package, and for performing, supervising or controlling another subsea task.

2. The method of claim 1, wherein the underwater vehicle stands off from the package to remain available underwater for providing power to the package.

3. The method of claim 1, comprising supplying, charging or replenishing the on-board power unit from an external energy source while the package is supported by the subsea structure.

4. The method of claim 3, comprising powering the tool or sensor from the on-board power unit while the package is not connected to the external energy source.

5. The method of claim 1, comprising running a program on board the package, or otherwise controlling the package, to perform the task autonomously or semi-autonomously of the underwater vehicle.

6. The method of claim 1, further comprising communicating data between the package and the underwater vehicle while the underwater vehicle stands off from the package.

7. The method of claim 6, wherein the underwater vehicle relays data from the package to a receiving point.

8. The method of claim 6, wherein the data comprises control signals sent from the underwater vehicle to the package.

9. The method of claim 1, wherein the underwater vehicle performs another task while it stands off from the package.

10. The method of claim 1, further comprising moving the package relative to the subsea structure while the package is supported by the subsea structure after being transferred from the underwater vehicle.

11. The method of claim 10, wherein said movement of the package relative to the subsea structure is self-propelled.

12. The method of claim 1, further comprising transferring the package from the subsea structure to the underwater vehicle once the task has been completed or interrupted.

13. The method of claim 12, further comprising moving the underwater vehicle to carry the package to a location at which the package is stored or recharged or replenished or data is downloaded from the package.

14. The method of claim 13, further comprising carrying a recharged or replenished package to a subsea structure to perform another task on that structure.

15. The method of claim 1, comprising attaching the package, upon its transfer from the underwater vehicle, to a mounting structure previously attached to the subsea structure.

16. The method of claim 15, further comprising moving the package along the mounting structure, relative to the subsea structure, after attaching the package to the mounting structure.

17. A submersible package that is attachable to a subsea structure and that is dependent upon an underwater vehicle for movement through water to the subsea structure, the package comprising:

a tool or sensor arranged to perform a task, said task being to inspect, monitor or maintain the subsea structure or to perform a construction task on the subsea structure while the underwater vehicle stands off from the package to remain available underwater for communicating with the package;

an on-board power unit arranged to power the tool or sensor to perform the task, the on-board power unit being reliant on the underwater vehicle for supply, charge or replenishment;

an on-board drive system arranged to act on the subsea structure to which the package is attached, to move the package relative to that structure when performing the task at different locations on the structure;

an on-board controller arranged to at least partially self-control the tool or sensor to perform the task; and an attachment facility for attaching the package to the subsea structure, the subsea structure being equipment installed subsea, and/or to the underwater vehicle, wherein the attachment facility comprises a formation to engage the subsea structure or the underwater vehicle.

18. The package of claim 17, further comprising an on-board attachment and release system arranged to drive the attachment facility of the package.

19. The package of claim 17, wherein the controller is programmed to control the tool or sensor to perform the task autonomously or semi-autonomously of the underwater vehicle.

20. The package of claim 17, further comprising an on-board input/output module arranged to transmit data to an external receiver and/or to receive command signals from an external controller.

21. A system for inspecting, monitoring or maintaining a subsea structure or performing a construction task on a subsea structure, the system comprising:

a submersible package as defined in claim 17;

an underwater vehicle movable to carry the package to the subsea structure; and a transfer arrangement for transferring the package from the underwater vehicle to be supported by the subsea structure, whereby the underwater vehicle is movable while remaining underwater to stand off from the package while the package is supported by the subsea structure for the tool or sensor of the package to inspect, monitor or maintain the subsea structure or to perform the construction task on the subsea structure;

wherein the underwater vehicle is arranged and connectable to the package to supply, charge or replenish the on-board power unit of the package.

22. The system of claim 21, wherein the package is carried to the subsea structure by a manipulator of the underwater vehicle.

23. The system of claim 21, wherein the transfer arrangement includes a manipulator of the underwater vehicle.

24. The system of claim 21, further comprising a deployment device for lowering the package separately from the underwater vehicle, from which device the underwater vehicle can fetch the package underwater to carry the package to the subsea structure.

25. The system of claim 21, wherein the tool or sensor of the package is operable when the package is disconnected from the underwater vehicle.

26. The system of claim 21, wherein the underwater vehicle is arranged to receive data from the package.

27. The system of claim 26, wherein the underwater vehicle is arranged to relay data from the package to a receiving point.

28. The system of claim 21, wherein the underwater vehicle is arranged to send control signals to the package.

* * * * *